US007692108B1

(12) United States Patent
Larranaga et al.

(10) Patent No.: US 7,692,108 B1
(45) Date of Patent: Apr. 6, 2010

(54) CIRCUIT BREAKER LOCK-OUT DEVICE

(75) Inventors: Javier Ignacio Larranaga, Plainview, CT (US); Peter James Greenwood, Cheshire, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/336,324

(22) Filed: Dec. 16, 2008

(51) Int. Cl.
*H01H 9/28* (2006.01)

(52) U.S. Cl. ..... 200/43.14; 200/43.15; 200/43.16; 200/43.19

(58) Field of Classification Search ..... 70/203; 200/43.01, 43.11, 43.14, 43.15, 43.16, 43.19, 200/318, 321, 322
See application file for complete search history.

(56) References Cited

U.S. PATENT DOCUMENTS 3,595,040 A * 7/1971 Curl ..... 200/43.15
4,158,116 A * 6/1979 Krueger ..... 200/43.19
4,260,861 A * 4/1981 DiMarco ..... 200/43.15
4,467,152 A 8/1984 Gordy
4,882,456 A * 11/1989 Hovanic et al. ..... 200/43.15
4,978,816 A 12/1990 Castonguay et al.
5,079,390 A 1/1992 Costanzo et al.
5,256,838 A 10/1993 Benda
5,310,969 A 5/1994 Turek et al.
5,449,867 A * 9/1995 Kelaita et al. ..... 200/43.14
5,467,622 A * 11/1995 Becker et al. ..... 70/203
5,521,344 A 5/1996 De Leo
5,909,019 A * 6/1999 Maloney et al. ..... 200/43.14
6,015,956 A * 1/2000 Green ..... 200/43.14
6,365,851 B1 * 4/2002 Gasper ..... 200/43.14
6,396,008 B1 * 5/2002 Maloney et al. ..... 200/43.14
6,703,572 B1 * 3/2004 Broghammer ..... 200/43.14

* cited by examiner

*Primary Examiner*—Michael A Friedhofer
(74) *Attorney, Agent, or Firm*—GE Global Patent Operation

(57) ABSTRACT

A circuit breaker lock-out device having a generally U-shaped cross section, configured to mount on a switch having a housing having a recess is provided. Device comprises a first leg connected with a second leg, said second leg having a first aperture configured to receive a blocking member, wherein at least one of said first and second legs has a protrusion configured to engage with said switch housing.

8 Claims, 5 Drawing Sheets

CIRCUIT BREAKER LOCK-OUT DEVICE

BACKGROUND OF THE INVENTION

1. Field of the Invention

The field of the present invention relates to locking devices generally, and more particularly to a locking device configured to prevent actuation of a switch handle 2. Description of the Related Art Typically, electrical distribution circuits include a panel board housing a multitude of switches or circuit breakers, each controlling a separate circuit. It is often necessary to safely "lock-out" or prevent one of the aforementioned circuit breakers from moving to the "ON" position, for example if the respective circuit is being maintained by personnel, while at the same time allowing other circuit breakers in the panel to be freely operable. In other instances, it may alternatively be desirable to lock-out a switching device from moving to the "OFF" position.

Typically the lock-out is accomplished by providing a lock-out device for an individual circuit breaker or a distribution panel, that mounts thereon and cooperates with a locking device, such as a padlock, which is located or otherwise disposed to prevent movement or toggling of the desired circuit breaker handle.

Circuit breakers may be of single or multiple pole configurations. A conventional single pole circuit breaker of the type commonly known in the art is shown in FIG. 7. A circuit breaker 14 includes an insulating housing 16 consisting of hollow molded base 17 and cover 18 that mate along a seam 44 forming circuit breaker top face 47, side faces 45, 46 and rear face 48. Typically, base 17 and cover 18 are configured with apertures 6, 7, 8, 11 which provide locations for retaining hardware 5 therein, such as for example rivets, to retain base 17 and cover 18 together as a single housing 16. Disposed within housing 16 are the current carrying elements (not shown) and contact operating mechanism (not shown). The latter is manually operable between "ON" and "OFF" positions by handle 12 extending forward from the top face 47 of housing 16 through an elongated aperture 15. The top face 47 of housing 16 typically has a raised portion or escutcheon 10 proximate to handle 12 and flat portions 9, 3. In a conventional application, circuit breaker 14 is installed in the field into a distribution panel (not shown), wherein a cover plate (not shown) is disposed on or slightly above flat portions 9, 3 with escutcheon 10 and handle 12 protruding through an opening (not shown) in the cover plate (not shown) to allow manual operation of the handle 12.

Many known prior art lock-out devices require costly and complicated multiple piece configurations and additional fastening hardware to install. Additionally, some prior art lock-out devices are difficult to orient such that the lock-out device aperture configured to cooperate with the lock is properly located proximate to the switch operating handle. Still other prior art lock-out devices are not readily field installable.

BRIEF DESCRIPTION OF THE INVENTION

In view of the foregoing considerations, it is desirable to provide an inexpensive and simple lock out device. It is also desirable to provide a lock-out device that comprises a single piece configuration that cooperates with a locking member and requires no hardware to install. It is also desirable to provide a field-installable lock-out device that is self-orienting with a circuit breaker housing to ensure proper alignment thereon.

In one embodiment of the invention, a circuit breaker lock-out device having a generally U-shaped cross section, configured to mount on a switch having a housing having a recess, and an operating handle operable between a first and a second position is provided. The lock-out device comprising a first leg connected with a second leg, said second leg having a first aperture configured to receive a blocking member, wherein at least one of said first and second legs having a protrusion configured to engage with said switch housing.

In another embodiment of the invention, method is described for configuring a lock-out device having a generally U-shaped cross section to position a blocking member to prevent operation of a switch, said switch including a housing configured with a recess, and an operating handle operable between a first and a second position. The method includes forming a first leg connected with a second leg; creating in said second leg a first aperture configured to position said blocking member on said switch; and creating on at least one of said first leg and said second leg a protrusion configured to engage said switch housing recess.

In another embodiment of the invention, method is described for installing a lock-out device having a generally U-shaped cross section with a protrusion on at least one of the legs, and configured to position a blocking member to prevent operation of a switch, said switch having a housing configured with a recess, and an operating handle operable between a first and a second position, on a switch. The method includes positioning said lock-out device proximate to said switch housing, orienting said lock-out device above said switch housing, applying a force to install the lock-out device on said switch housing, allowing the legs of said generally U-shaped cross section to flex outwardly, and removing said force when said protrusion is received by said switch housing aperture.

The above brief summary sets forth rather broadly the more important features of the present invention in order that the detailed description thereof that follows may be better understood, and in order that the present contributions to the art may be better appreciated. In this respect, before explaining several embodiments of the invention in detail, it will be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings. The accompanying drawings, which are incorporated in and constitute a part of the specification, illustrate a presently preferred embodiment of the invention, in which.

DETAILED DESCRIPTION OF THE PREFERRED EMBODIMENTS

Figure 1:
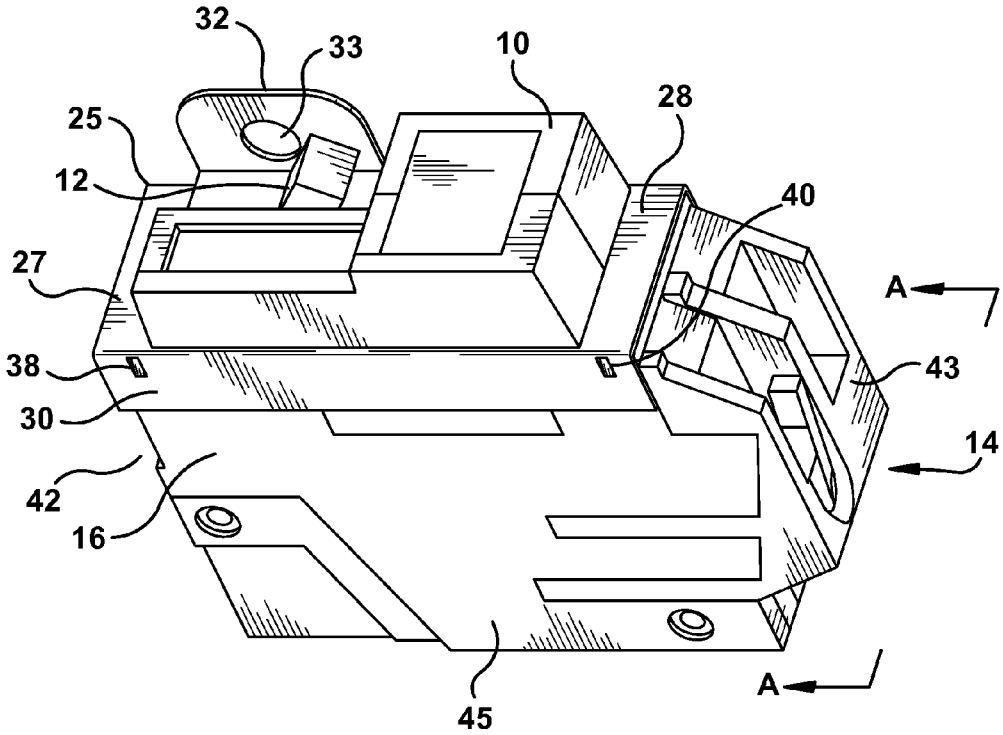
FIG. 1 illustrates a perspective view of a circuit breaker having lock-out device of an embodiment of the present invention installed thereon.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Referring now to the drawings, wherein like reference numerals designate identical or corresponding parts throughout the several views, one of the embodiments of the current lock-out device of the present invention will now be described.

Figure 3:
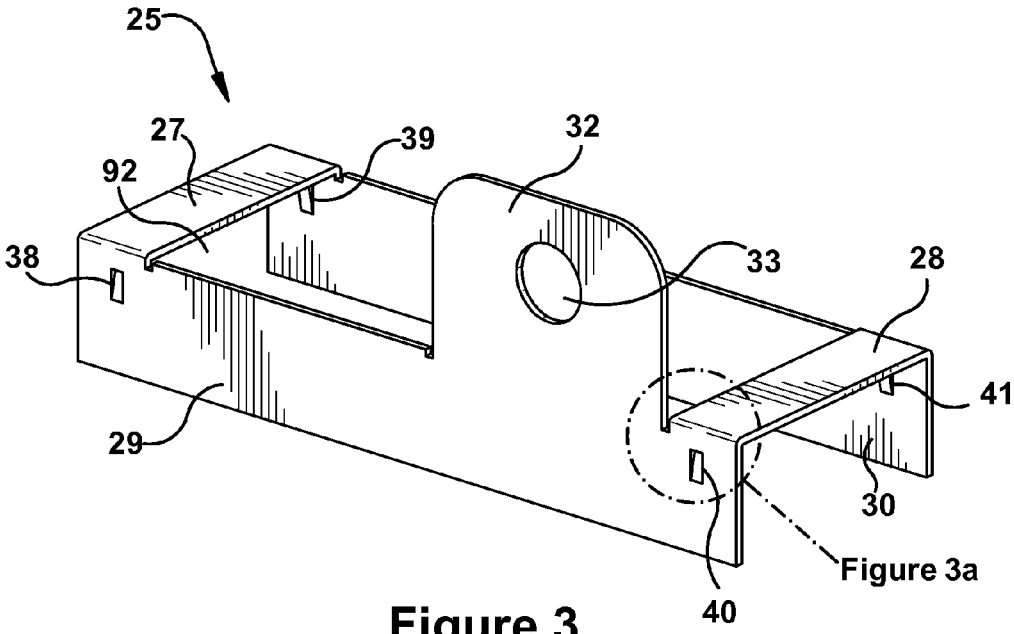
FIG. 3 illustrates a perspective view of an embodiment of lock-out device of the present invention.
Figure 3A:
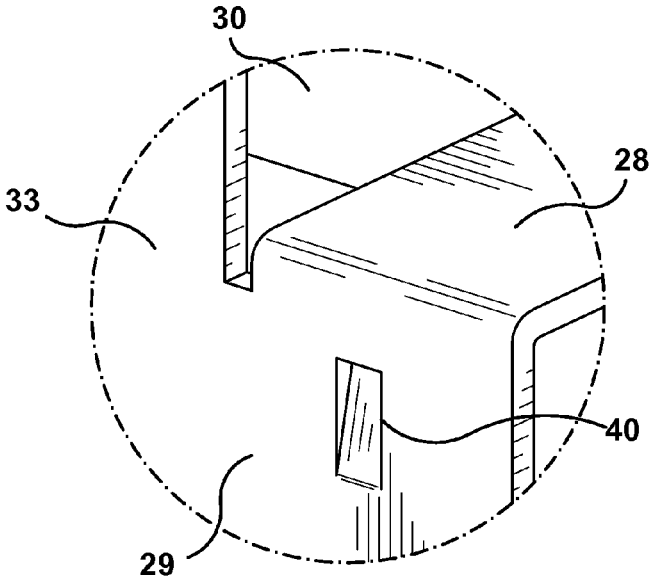
FIG. 3*a* illustrates a magnified detail view of a feature of the lock-out device of FIG. 3.

FIGS. 3 and 3*a* illustrate an exemplary lock-out device 25 of an preferred embodiment of the present invention in perspective view. Lock-out device 25 is generally U-shaped in cross-section and preferably formed of a single piece of relatively rigid material such as stainless steel having a thickness of about 0.028 in. (0.711 mm). Lock-out device 25 preferably includes locating surfaces 27, 28 forming the bight of the generally U-shaped cross section, and legs 29, 30 configured to form an aperture 92. Leg 29 is provided with a tab or extension 32 with an aperture 33. Lock-out device 25 is shown with legs 29, 30 configured with protrusions 38, 39, 40, 41 disposed thereon and being oriented to be received within with the recesses 6, 7, 8, 11 of a circuit breaker housing 16 (FIG. 4) to retain lock-out device 25 on the circuit breaker 14. In one embodiment, protrusions 38, 39, 40, 41 are formed integral to lock-out device 25, for example by a lancing, stamping or staking operation. In an exemplary embodiment, the lanced protrusions 38, 39, 40, 41 each form an angle of between 10 and 15 degrees with respect to their respective legs 29, 30 in order to maximize the retention forces of lock-out device 25 on the circuit breaker 14. The protrusions 38, 39, 40, 41 are each lanced to have a width of about 0.062 in. (1.57 mm), a height of about 0.125 in. (3.18 mm), and have a depth of about 0.025 in. (0.64 mm).

Figure 7:
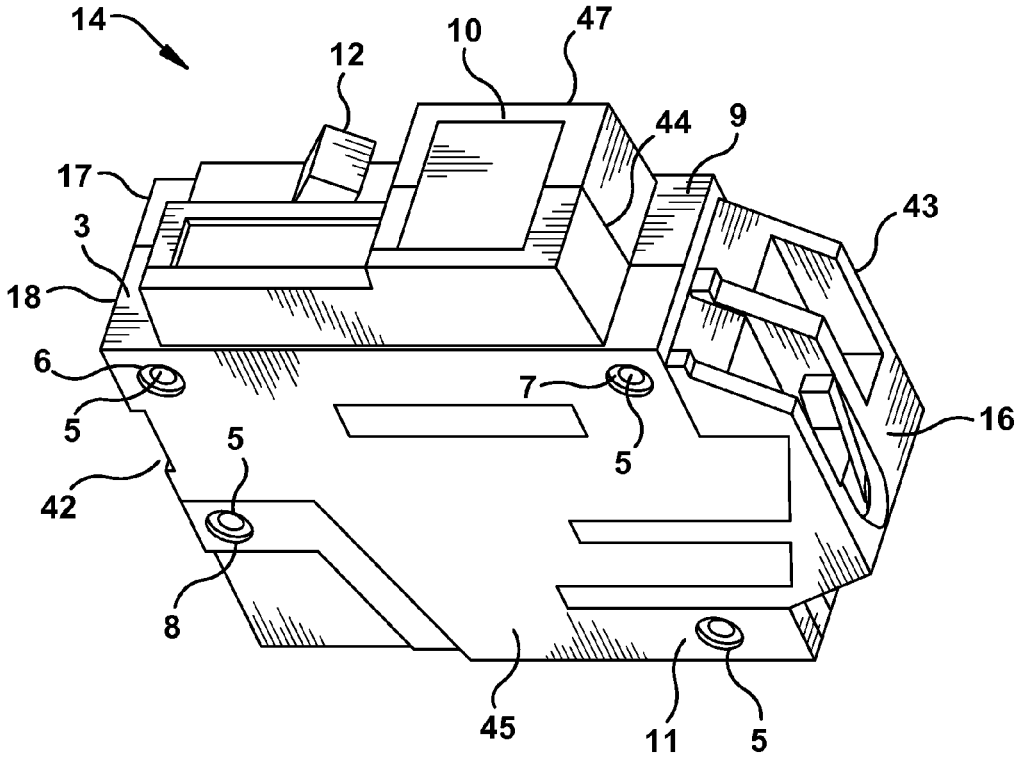
Figure 7 (Prior Art)
FIG. 7 illustrates a perspective view of a conventional circuit breaker of the kind known in the art without an embodiment of the present invention installed thereon.

FIG. 1 illustrates an exemplary lock-out device 25 of a preferred embodiment of the present invention shown in operative position installed on a circuit breaker 14. Referring to FIGS. 1, 2, 3, 3*a*, Leg 29 is provided with the extension 32 extending outward from housing 16 proximate to one side of handle 12 and in a plane generally parallel to the plane of movement for handle 12, and configured with the aperture 33 proximate to circuit breaker operating handle 12. Aperture 33 is oriented to receive a suitable blocking device such as a shackle 35 of a padlock 36 for example. Locating surfaces 27, 28 are disposed on circuit breaker face flat portions 9, 3 (FIG. 7) and cooperate with circuit breaker face escutcheon 10 and establish the proper end-to-end position for lock-out device 25 on housing 16. It will be understood that locating surfaces 27, 28 can alternatively cooperate with circuit breaker housing 16 ends 42, 43 or other features of the circuit breaker housing 16 without departing from the scope of the invention.

Figure 2:
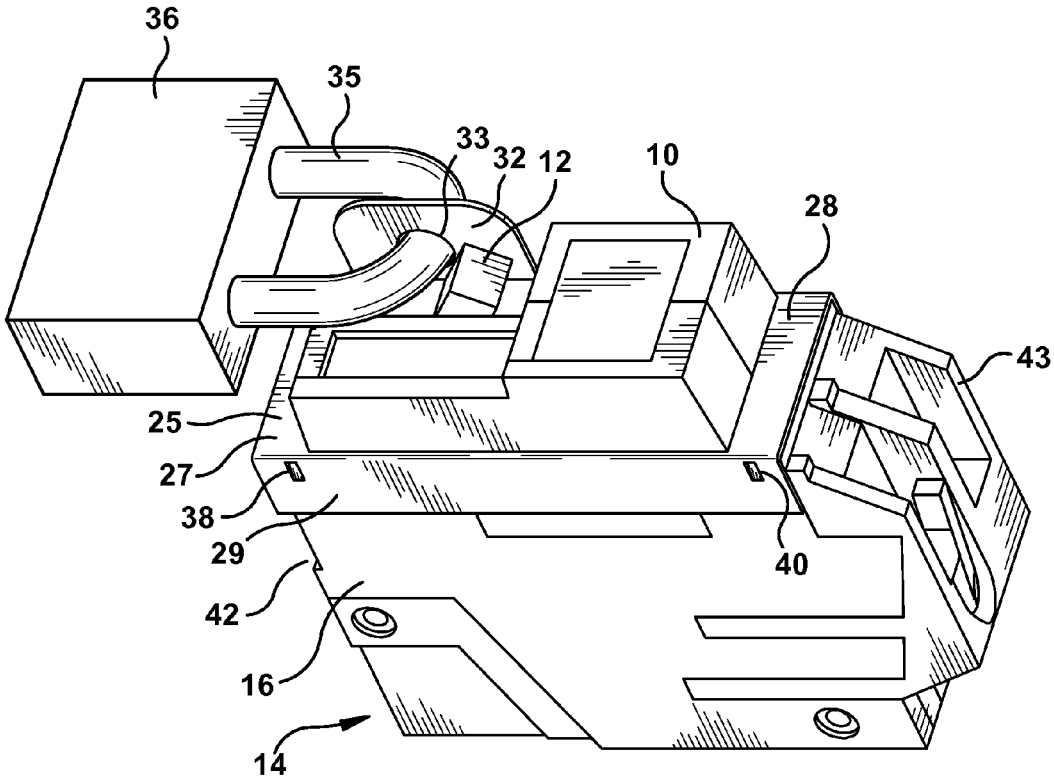
FIG. 2 illustrates a perspective view of the elements of FIG. 1 with a padlock mounted thereon which blocks the circuit breaker handle to prevent movement thereof from a first position to a second position.

Referring to FIG. 2, a padlock 36 having a shackle 35 is shown mounted to the lock-out device 25. The shackle 35 is positioned by aperture 33 on extension 32 so as to block movement of handle 12 of circuit breaker 14 from a first position to a second position, such as for example from an "OFF" position an "ON" position. It will be appreciated that as an alternative to a padlock 36 having a shackle 35, any of a variety of suitable blocking devices can cooperate with aperture 33 on extension 32 to block movement of handle 12 of circuit breaker 14 from a first position to a second position without departing from the scope of the invention.

In the event handle 12 of circuit breaker 14 is in the "ON" position, the aperture 33 on extension 32 is proximate to and aligned with handle 12 such that handle 12 prevents insertion of a blocking device through aperture 33, thus preventing handle 12 from inadvertently being locked in the "ON" position.

If desired, the location of aperture 33 on extension 32 may alternatively be selected to enable a blocking device, such as a padlock 36 having a shackle 35, to block movement of handle 12 of the circuit breaker 14 to the circuit breaker "OFF" position. It will be understood that the location of the aperture 33 on extension 32 may be determined at the time of manufacture or by modification, such as by drilling for example, in the field.

Figure 4:
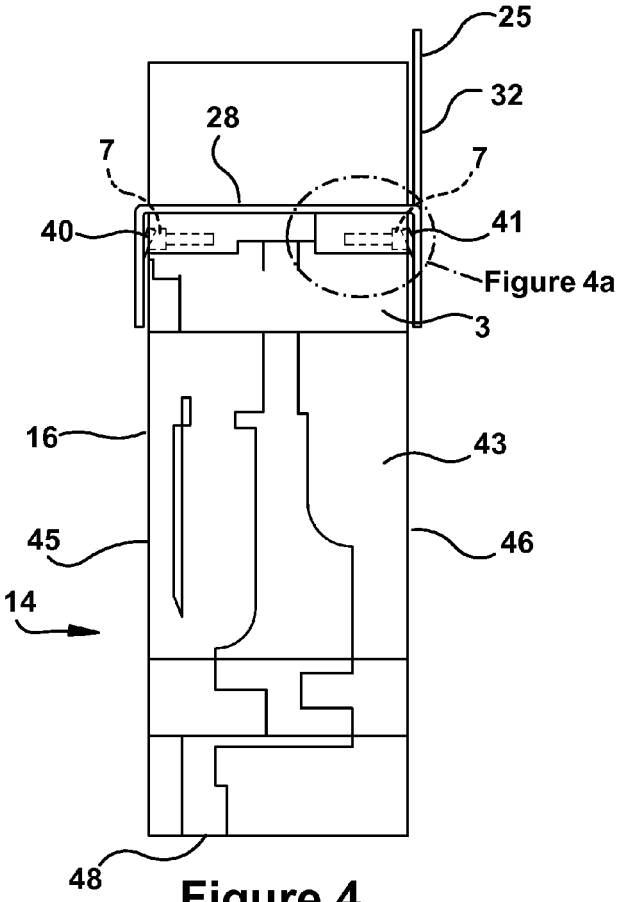
FIG. 4 illustrates an end view of the lock-out device of FIG. 1 looking in the direction A-A.
Figure 4A:
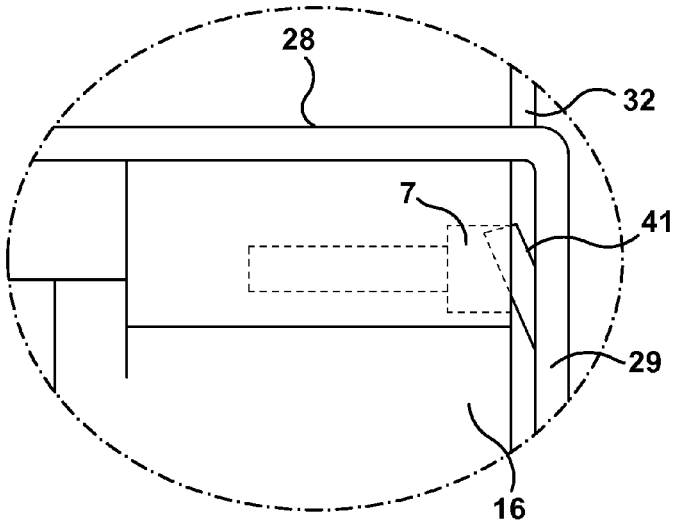
FIG. 4*a* illustrates a magnified detail view of a feature of the lock-out device of FIG. 4.

Referring to FIG. 4, an end view of the lock-out device of FIG. 2 is shown looking in the direction A-A. In the magnified detail view of FIG. 4*a*, protrusion 41 is shown received within the aperture 7 and retaining lock-out device 25 on circuit breaker 16.

It will be apparent from the description herein that lock-out device 25 may be easily installed on circuit breaker housing 16 manually and without need of tools. Lock-out device 25 is installed on switch housing 16 by manually orienting the lock-out device 25 above the switch housing 16 such that each leg 29, 30 is aligned above the housing 16 side faces 45, 46, with aperture 92 aligned above escutcheon 10 such that the tab 32 is proximate to the switch handle 12. By applying a downward force to the lock-out device 25 and sliding over the switch housing 16, the legs 29, 30 flex slightly outwardly. The downward force is removed when the protrusions 38, 39, 40, 41 are received by the apertures 6, 7, 8, 11 and the legs 29, flex back to original orientation. However, once protrusions 38, 39, 40, 41 are received within with the recesses 6, 7 of the circuit breaker housing 16, tools will be required to remove lock-out device 25 from circuit breaker housing 16 resulting in distortion or other damage to the lock-out device 25.

With respect to the above description, it should be realized that the optimum dimensional relationships for the parts of the invention, to include variations in size, form function and manner of operation, assembly and use, are deemed readily apparent and illustrated in the drawings and described in the specification are intended to be encompassed only by the scope of appended claims.

In addition, while the present invention has been shown in the drawings and fully described above with particularity and detail in connection with what is presently deemed to be practical and several of the preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope claims, or if they include equivalent structural elements with insubstantial differences from the literal languages of the claims.

What is claimed is:

1. A lock-out device having a generally U-shaped cross section, configured to mount on a switch having a housing comprising a face and a sidewall oriented generally orthogonal to the face, the sidewall having a recess, and an operating handle operable between a first and a second position, said lock-out device comprising:

a first leg portion and a second leg portion connected at a bight portion;

said first and second leg portions and said bight portion configured in a generally U-shaped cross section;

said first leg portion being further connected with a tab portion;

said bight portion comprising a locating portion, and configured to be installed on the housing face;

said locating portion being arranged to functionally locate said bight portion on the housing face;

said tab portion comprising a first aperture configured to receive a blocking member;

wherein at least one of said first and second leg portions has a protrusion configured to engage with the recess in the switch housing sidewall.

2. The device of claim 1 wherein:

said blocking member is a shackle of a lock.

3. The device of claim 1 wherein:

said protrusion is configured to engage the recess in at least one of said at least two switch housing sidewalls.

4. The device of claim 1 wherein:

said location portion comprises a second aperture.

5. The device of claim 1 wherein:

said first aperture and said switch handle are oriented to prevent reception of said blocking member when said switch handle is in said second position.

6. A method for configuring a lock-out device having a generally U-shaped cross section to position a blocking member to prevent operation of a switch, said switch having a housing comprising a face and a sidewall oriented generally orthogonal to the face, the sidewall configured with a recess, and an operating handle operable between a first and a second position, to position a blocking member to prevent operation of a switch, said switch having a housing configured with a recess, and an operating handle operable between a first and a second position, comprising the steps of:

forming a first leg a portion and a second leg portion connected at a bight portion;

configuring said first and second leg portions and said bight portion in a generally U-shaped cross section;

connecting a tab portion to said first leg portion;

configuring a locating portion on said bight portion configured to locate said bight portion on the housing face;

creating in said tab portion a first aperture configured to position the blocking member on said the switch; and creating on at least one of said first and said second leg portions a protrusion configured to engage the recess in the switch housing sidewall.

7. The method of claim 6, further comprising the step of:

mounting said lock-out device on the switch.

8. The method of claim 7, further comprising the step of:

orienting said lock-out device to prevent reception of said blocking member by said first aperture when said switch handle is in the second position.

* * * * *

UNITED STATES PATENT AND TRADEMARK OFFICE

CERTIFICATE OF CORRECTION

PATENT NO. : 7,692,108 B1
APPLICATION NO. : 12/336324
DATED : April 6, 2010
INVENTOR(S) : Larranaga et al.

It is certified that error appears in the above-identified patent and that said Letters Patent is hereby corrected as shown below:

In Column 4, Line 50, delete "legs 29," and insert -- legs 29, 30 --, therefor.

In Column 6, Line 28, in Claim 6, after "on" delete "said".

In Column 6, Line 20, in Claim 6, delete "leg a" and insert -- leg --, therefor.

Signed and Sealed this
Twenty-second Day of March, 2011

David J. Kappos

David J. Kappos
*Director of the United States Patent and Trademark Office*